US006698364B2

(12) United States Patent
Welch et al.

(10) Patent No.: US 6,698,364 B2
(45) Date of Patent: Mar. 2, 2004

(54) FOLDING WORK STATION

(75) Inventors: Robert J. Welch, Dallas, PA (US); Joseph P. Jones, Wilkes-Barre, PA (US); Douglas J. Kaminski, Wilkes-Barre, PA (US); Robert R. Steele, Sweet Valley, PA (US); Robert K. Swartz, Dallas, PA (US); Alan R. Grula, Wilkes-Barre, PA (US)

(73) Assignee: Metro Industries, Inc., Reno, NV (US)

( * ) Notice: Subject to any disclaimer, the term of this patent is extended or adjusted under 35 U.S.C. 154(b) by 0 days.

(21) Appl. No.: 09/920,753

(22) Filed: Aug. 3, 2001

(65) Prior Publication Data

US 2003/0024444 A1 Feb. 6, 2003

(51) Int. Cl.[7] ..... A47B 3/00
(52) U.S. Cl. ..... 108/115; 108/128
(58) Field of Search ..... 108/115, 128, 108/119, 162, 166, 177, 179; 16/35 R

(56) References Cited

U.S. PATENT DOCUMENTS 1,158,212 A * 10/1915 Henderson
2,857,228 A * 10/1958 Koett
3,322,077 A * 5/1967 Kovacik
3,527,174 A * 9/1970 Lay
4,938,153 A * 7/1990 Maes
5,622,119 A * 4/1997 Hsieh
5,644,994 A * 7/1997 Liang et al.
5,904,104 A * 5/1999 Yu
5,927,214 A * 7/1999 Schwartz et al.
6,079,941 A * 6/2000 Lee ..... 16/35 R
6,192,808 B1 * 2/2001 Bue

FOREIGN PATENT DOCUMENTS

CH 250145 * 8/1947

* cited by examiner

*Primary Examiner*—Jose V. Chen
(74) *Attorney, Agent, or Firm*—Fitzpatrick, Cella, Harper & Scinto

(57) ABSTRACT

A folding work station includes a work surface and a frame supporting the work surface. The frame includes at least one rolling support and is selectively expandable to an open configuration, in which the frame supports the work surface in a working orientation, and foldable to a substantially flat closed configuration having a vertical orientation, in which the frame supports the work surface juxtaposed on the frame. In addition, the work station is movably supported on the rolling support(s).

37 Claims, 9 Drawing Sheets

FOLDING WORK STATION

FIELD OF THE INVENTION

The present invention relates generally to work stations, and more particularly to a folding work station, such as a sampling station, utilizing a ventilated wire shelving system. When folded, the folding work station presents a compact structure having a substantially flat vertical orientation and rolling support(s) to facilitate remote storage.

BACKGROUND OF THE INVENTION

Work stations commonly are used in supermarkets and other specialty stores for providing a temporary sampling station to sample various articles or food items, such as hors d'oeuvres and desserts. Typically, such sampling stations include a work surface for presenting the sample articles or food items. Various display materials, such as advertising, recipes or ingredients, typically may be displayed nearby. Since the distribution of such samples is not a continuous process, such sampling stations often are disassembled for remote storage between uses.

Work stations which may be disassembled for storage are known. For example, wire shelving systems have found wide use in commercial and residential applications. A typical adjustable wire shelving system of the knockdown type generally comprises a plurality of support posts, usually four, provided for supporting a shelf at the four respective corners thereof. Each post includes spaced, horizontal grooves for receiving a tapered sleeve. Each shelf is formed to have frustro-conically shaped openings, or collars, at each corner. The sleeves are positioned on the posts and then received within the collars to support the shelf.

Conventional ventilated wire shelving generally includes a plurality of longitudinally extending wire members and a plurality of transversely extending wire members welded to one another at their respective intersecting points to form a sturdy, often rigid, wire grid structure. For additional support, a vertically oriented edge beam may be provided around the perimeter of the shelf by a serpentine-like member and a lower support member cooperating with a peripheral top wire.

Shelving systems as described above can be found in U.S. Pat. No. 3,523,508 and No. 3,757,705. These shelving systems are sold and marketed under the trademark SUPER ERECTA SHELF by InterMetro Industries Corporation of Wilkes-Barre, Pa.

Shelving systems having ventilated wire shelves are readily adaptable for storing and supporting a wide array of items, such as food items, boxes, tools, etc. Such shelving systems have particular utility in the food industry, because they provide a sturdy, lightweight, sanitary, and easily maintained environment for storing and presenting food items.

Knockdown type wire shelving systems as described above have great utility in many applications. However, a need exists for a work station that provides the advantages of a shelving system and that is easily and quickly set up or remotely stored on an as needed basis. In particular, a need exists for a mobile work station, such as a food sampling station, that is sturdy and yet is quickly and easily transportable and adapted for compact storage.

SUMMARY OF THE INVENTION

Accordingly, an object of the present invention is to provide a folding work station, such as a sampling station, that may be easily and quickly set up or compactly stored away on an as needed basis.

Another object of the present invention is to provide such a folding work/sampling station that is mobile when folded to facilitate remote storage.

In one aspect, the present invention relates to a folding work station including a work surface and a frame supporting the work surface, where the frame includes at least one rolling support. The frame is selectively expandable to support the work surface in a first state, in which the frame is in an open configuration, the work surface is exposed in a working orientation, and the work station is stationary, and foldable to a second state, in which the frame lays flat in a closed configuration having a vertical orientation, the work surface is supported juxtaposed on the frame, and the work station is movably supported by the rolling support(s) of the frame.

In another aspect, the foldable work station of the present invention supports the work surface at fixed support locations at opposing ends of the work surface. In a preferred embodiment, the folding work station includes respective pivot connections between the foldable frame and the work surface at the fixed support locations.

In another aspect, the foldable work station of the present invention includes a first support frame, a second support frame, and foldable frame. The foldable frame connects the first support frame, the second support frame, and the work surface for relative movement between the first state, in which the second support frame is fixed relative to the first support frame at a location spaced apart from the first support frame, with the work surface supported between the first support frame and the second support frame, and the second state, in which the second support frame, the foldable frame, and the work surface are supported juxtaposed on the first support frame.

In another aspect, the foldable frame includes a locking brace for locking the work station in the first state. In a preferred embodiment, in the first state the locking brace cooperates with the first support frame, the second support frame and the work surface so as to fix the second support frame at a location spaced apart from the first support frame, with the work surface supported between the first support frame and the second support frame; in the second state, the locking brace folds up and also is supported juxtaposed on the first frame. In a preferred embodiment, the locking brace is an elbow brace including an upper arm, a lower arm, and a lockable hinge between the first arm and the second arm, where one arm of the locking brace is pivotably supported at a common pivot connection between the work surface and one of the first support frame and the second support frame, and the other arm of the locking brace is pivotably supported at a pivot connection on the other one of the first support frame and the second support frame.

In another aspect, each rolling support of the first support frame includes at least one caster, roller, wheel, or the like. For safety and ease of handling, the first support frame preferably includes at least one rolling support arranged to provide linear movement only, along a direction of a line in a plane of the first support frame. Also, each rolling support optionally may be selectively locked to prevent undesired movement, e.g., when the folding work station is expanded to the open configuration for use, or when the folding work station is folded for storage.

In another aspect, the folding work station of the present invention may include an optional base shelf. In a preferred embodiment, the optional base shelf is supported by the first support frame and the second support frame at fixed support locations at opposing ends of the base shelf, where the foldable frame includes respective pivot connections between the first and second support frames and the base shelf at the fixed support locations. The base shelf preferably is a ventilated wire shelf having a width substantially similar to the work surface, and is spaced apart from the work surface so as to form a parallelogram with the work surface, the first support frame and the second support frame, when viewed from a side of the work station.

In another aspect, the folding work station of the present invention may include an optional intermediate shelf. As with the optional base shelf, in a preferred embodiment the intermediate shelf is supported by the first support frame and the second support frame at fixed support locations at opposing ends of the intermediate shelf, and the foldable frame includes respective pivot connections between the first and second support frames and the intermediate shelf at the fixed support locations. The intermediate shelf preferably is a ventilated wire shelf having a width substantially similar to the work surface, and is spaced apart from the work surface so as to form a parallelogram with the work surface, the first support frame and the second support frame, when viewed from a side of the work station. In a preferred embodiment, one end of a locking brace is pivotably connected at a common pivot connection of the work surface and one of the first and second support frames, and the other end of the locking brace is pivotably connected at a common pivot connection of the intermediate shelf and the other one of the first and second support frames.

In another aspect, the folding frame includes optional securing structure, such as a resilient C-clip, for securing the first support frame together with the second support frame when the folding work station is folded in the closed configuration, and the second support frame is supported juxtaposed on the first support frame.

In another aspect, the folding work station of the present invention utilizes ventilated wire shelving construction. In a preferred embodiment, the folding work station includes a base shelf and/or an intermediate shelf, each formed of ventilated wire shelving.

These and other objects, aspects and features of the present invention readily will become apparent from the following detailed description of the preferred embodiments of the present invention, read in conjunction with reference to the accompanying drawings.

DETAILED DESCRIPTION OF THE PREFERRED EMBODIMENTS

First Embodiment

Figure 1:
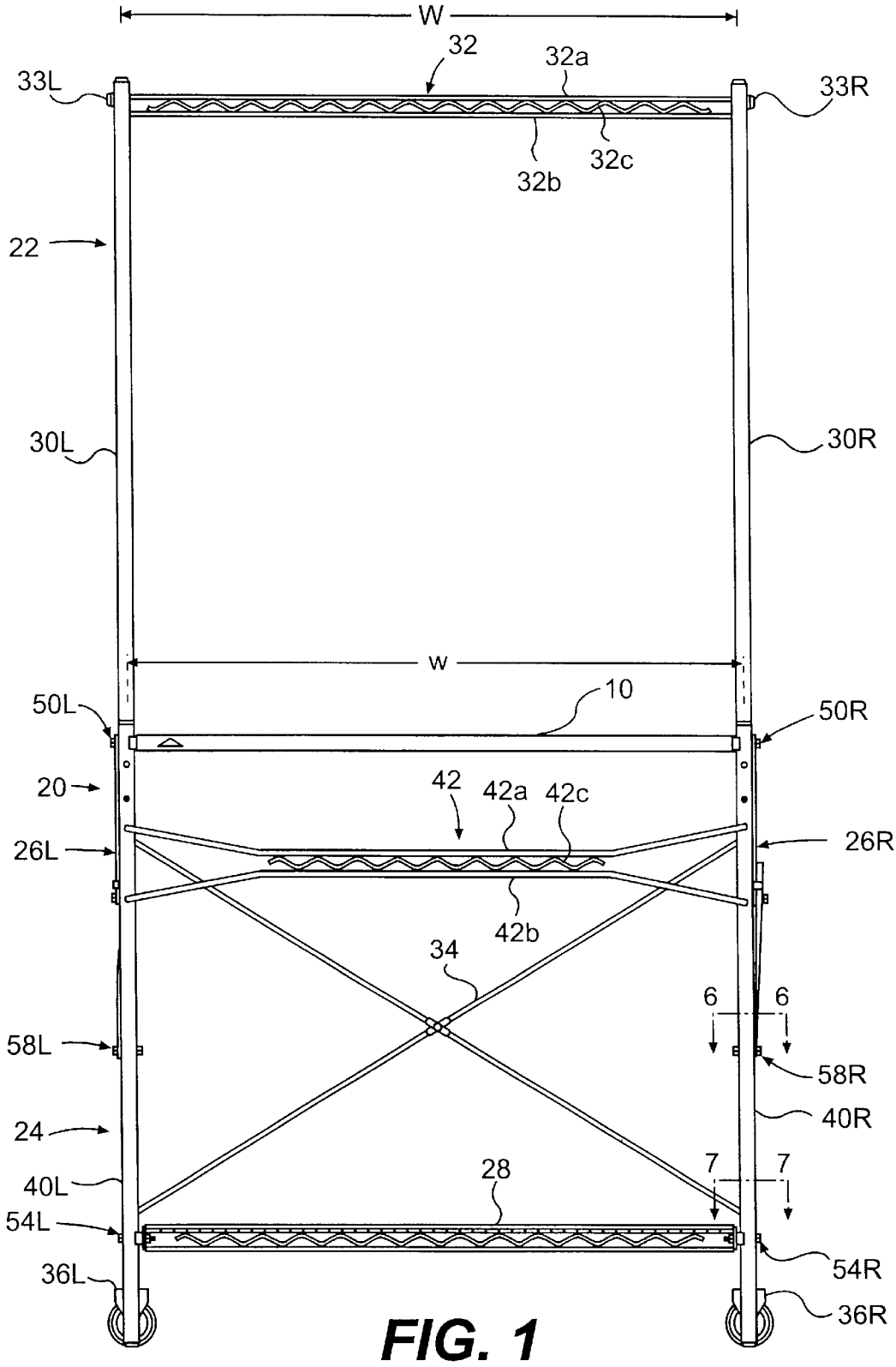
FIG. 1 is a front elevational view of a folding work station according to a first embodiment of the present invention, illustrating the folding work station in a first state, in which the work station is locked in an open configuration, and the work station is provided with an optional base shelf.
Figure 2:
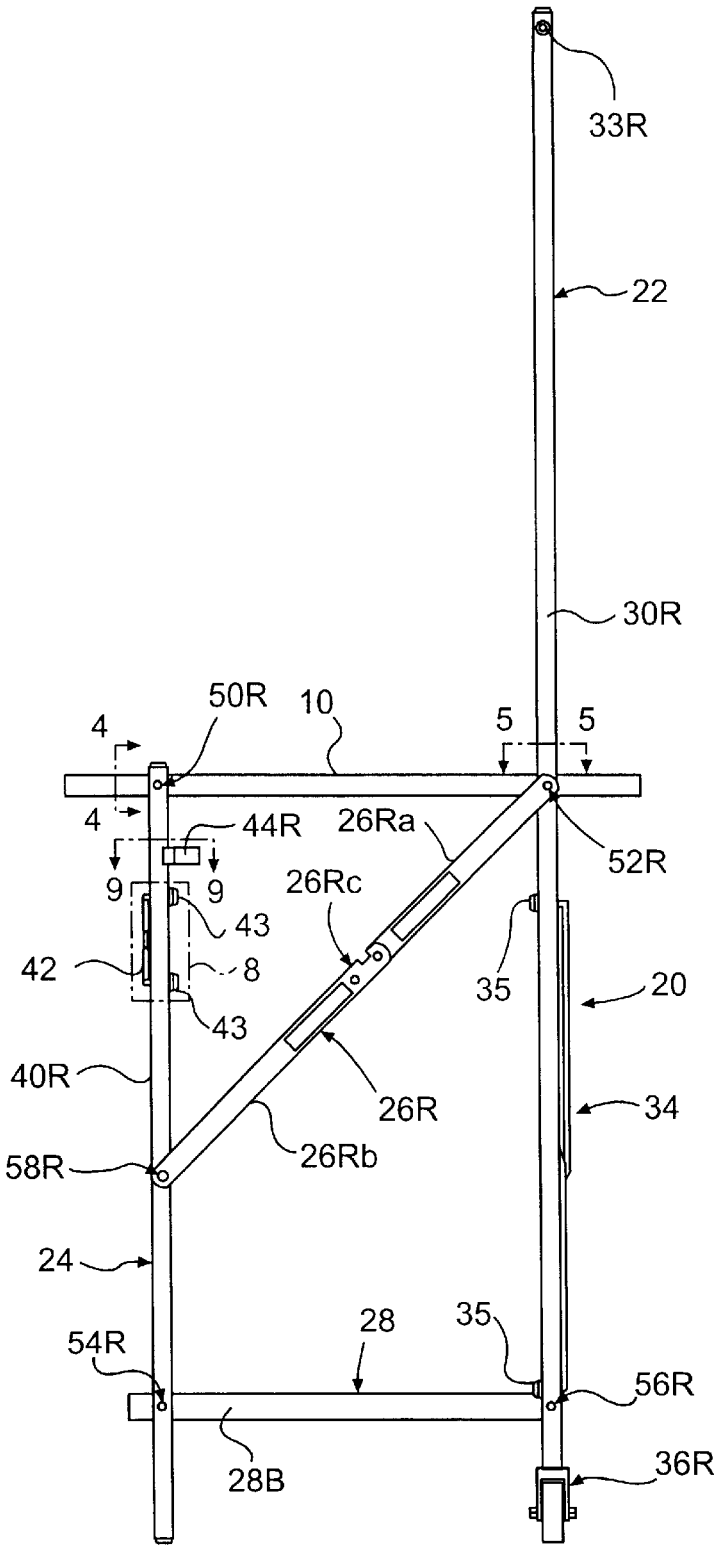
FIG. 2 is a side elevational view of the folding work station illustrated in FIG. 1.
Figure 3:
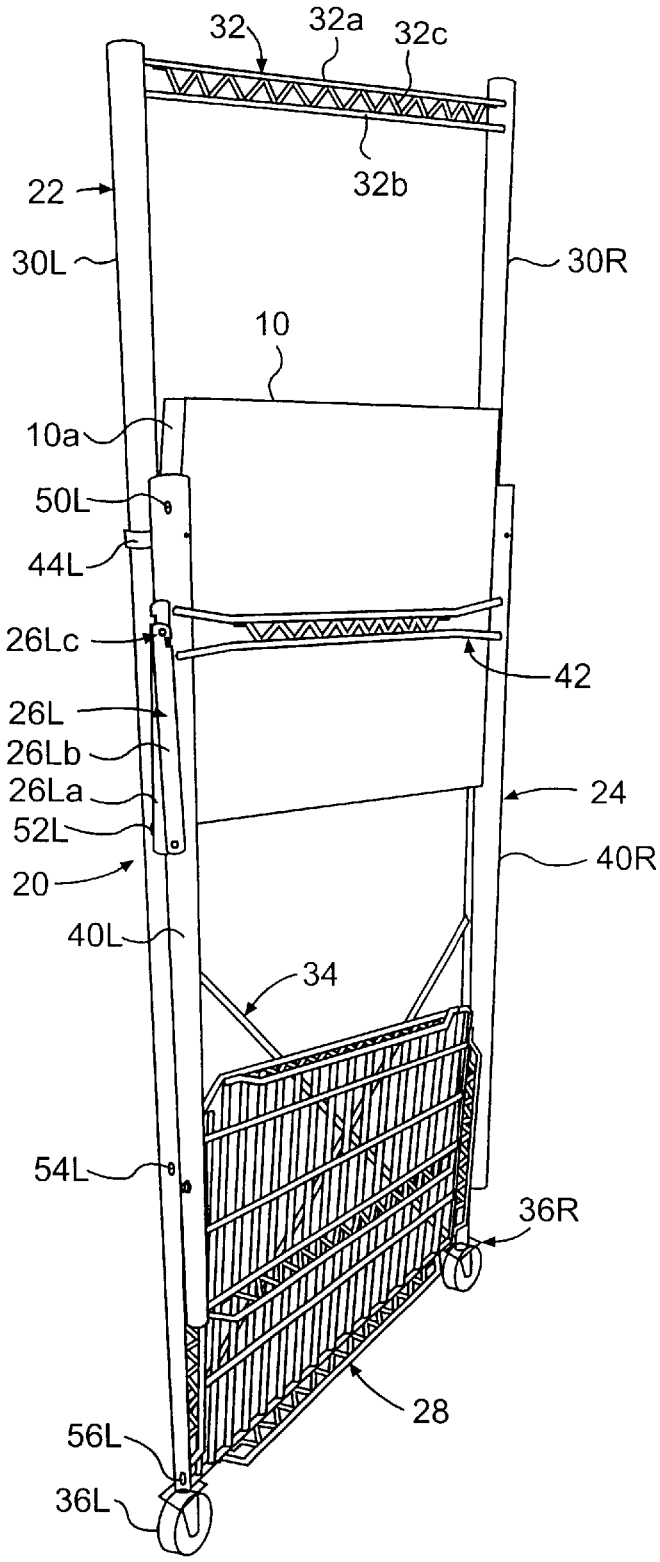
FIG. 3 is a side perspective view of the folding work station of FIGS. 1 and 2, illustrating the folding work station in a second state (closed configuration), in which the work station is folded for storage.

FIGS. 1 and 2 are a front view and a side view, respectively, of a folding work station according to a first embodiment of the present invention, illustrating the folding work station in a first state (open, locked configuration). FIG. 3 is a side perspective view illustrating the folding work station of FIGS. 1 and 2 in a second state (closed configuration), in which the work station is folded for storage. In the present embodiment, the folding work station is a sampling station for use, e.g., in a supermarket, restaurant or commercial department store.

The folding work station generally includes a work surface 10 and a foldable frame 20. In the present embodiment, the foldable frame 20 generally includes a first support frame 22, a second support frame 24, and at least one locking brace 26. In the present embodiment, the folding work station also includes an optional base shelf 28.

In this regard, designations "R" and "L" are used herein to refer to right and left, as viewed from the front in FIG. 1, and are arbitrarily assigned for convenience of description. For ease of production, the elements used on both the right and left sides of the work station are preferably the same elements but simply reversed when constructing the work station. Accordingly, a description herein of one element, with or without reference to the "R" or "L" designation, likewise provides a description of the "opposite side" element having the same reference number.

The work surface 10 generally is a rigid structure. In the sampling station of the present embodiment, the work surface 10 preferably is a rectangular tray having a solid top surface for supporting and presenting sample food items, as is well known in the art.

The first support frame 22 is provided at the rear or back of the folding work station, and generally includes a pair of vertical supports 30R, 30L, lateral support bracing, and at least one rolling support 36. In the present embodiment, the pair of vertical supports 30R, 30L are spaced apart at a width "W", the lateral support bracing includes a crown brace 32 and a cross brace 34, and the first support frame 22 includes a pair of rolling supports 36R, 36L.

The second support frame 24 is provided at the front of the folding work station, and generally includes a pair of vertical supports 40R, 40L, and lateral support bracing. In the present embodiment, the pair of vertical supports 40R, 40L are spaced apart at a width "w", and the lateral support bracing includes a stabilizing brace 42. As discussed below, the spacing of the vertical supports 40R, 40L preferably is set so that the width of vertical supports 30 is substantially equal to the width of vertical supports 40 (W≅w), so that vertical supports 30 and 40 lay juxtaposed when the folding work stations is in the folded, closed configuration. (See, FIG. 3). The second support frame 24 also is shown having optional resilient C-clips 44R, 44L, providing means for securing the first support frame 22 and the second support frame 24 together when the folding work station is in the folded, closed configuration.

In the present embodiment, the first and second support frames 22, 24 pivotably support the work surface 10 at fixed support locations at opposing ends of the work surface 10. More specifically, pivot connections 50R, 50L are provided at opposing sides of one end of work surface 10 (the front end), whereby the second support frame 22 pivotably supports the front end of work surface 10 on a common pivot axis extending between vertical supports 40R, 40L; likewise, pivot connections 52R, 52L are provided at opposing sides of the other/opposing end of work surface 10 (the rear end), whereby the first support frame 22 pivotably supports the rear end of work surface 10 on a common pivot axis extending between vertical supports 30R, 30L.

Optional base shelf 28 generally has the same width as the work surface 10 but a reduced depth, and likewise provides a rigid structure extending between, and pivotably supported by each of, the first support frame 22 and the second support frame 24. More specifically, pivot connections 54R, 54L are provided at opposing sides of one end of the base shelf 28 (the front end), whereby the second support frame 24 pivotably supports the front end of base shelf 28 on a common pivot axis extending between vertical supports 40R, 40L; likewise, pivot connections 56R, 56L are provided at opposing sides of the other/opposing end of the base shelf 28 (the rear end), whereby the first support frame 22 pivotably supports the rear end of base shelf 28 on a common pivot axis extending between vertical supports 30R, 30L.

Referring particularly to FIG. 2, in the present embodiment the respective points of connection of each of the work surface 10 and the base shelf 28 to the first and second support frames 30, 40 (that is, the respective pivot connections) are arranged with a selected spacing, such that, when the work station is in the open configuration, the first support frame 22, the second support frame 24, the work surface 10 and the base shelf 28 form the four sides of a parallelogram, when viewed from the side of the work station.

As shown in FIG. 2, in the present embodiment the foldable frame 20 thus may be expanded to a first state, or open configuration, in which the first support frame 22, the second support frame 24, the work surface 10 and the base shelf 26 are pivotably moved relative to one another so as to form the four sides of a right parallelogram. In this state, each locking brace 26R, 26L may be locked so as to fix the first support frame 22, the second support frame 24, the work surface 10 and the base shelf 28 in a sturdy right parallelogram configuration.

Alternatively, as shown in FIG. 3, the locking braces 26 may be released, and the second support frame 24 may be lifted and translates relative to the first support frame 22 while remaining in a substantially parallel relationship therewith. As the second support frame translates, the work surface 10 and the base shelf 28 rotatably pivot relative to the first and second support frames. In this manner, the frame of the work station may be folded to a second state, or closed configuration, in which the first support frame 22, the second support frame 24, the work surface 10 and the base shelf 28 lay flat relative to one another, juxtaposed in a vertical orientation.

The materials and construction of each of the various individual elements constituting the first embodiment of the present invention are, per se, conventional.

The tray of work surface 10 preferably is made from a formed/pressed metal sheet, such as a stainless steel or aluminum sheet. The tray may be formed with an "optional recessed central portion," to provide a storage compartment, and to provide additional rigidity and stability, as is well known in the art. Those skilled in the art readily will be able to select alternative materials and configurations suitable for any intended purpose.

Each vertical support 30R, 30L, 40R, 40L generally is a light weight, rigid, support post. In the preferred embodiment, each vertical support 30R, 30L, 40R, 40L is a metal tube, preferably a hollow stainless steel, aluminum or chrome plated steel tube. Open ends at the top and bottom of each vertical support 30R, 30L, 40R, 40L preferably are capped or otherwise treated for safety and ease of handling, as is conventionally known in the art. The height of the front vertical supports generally is selected in accordance with the desired height of the work surface. The height of the rear vertical supports 40R, 40L generally is selected in accordance with the desired height of the work station, e.g., for facilitating handling during transport of the work station in the folded, closed configuration, and/or for providing a physical structure for presenting a display or advertising above the work surface 10.

In the preferred embodiment, each locking brace 26 is an elbow brace including an upper arm 26*a*, a lower arm 26*b*, and a locking hinge 26*c* pivotably connecting the upper arm 26*a* and the lower arm 26*b*, where the locking hinge 26*c* selectively may be locked with the upper arm 26*a* and the lower arm 26*b* arranged in a substantially straight line. In the closed configuration, the locking braces 26 are folded and supported juxtaposed on the first support frame 22. For example, as shown in FIG. 3, upper arm 26La and lower arm 26Lb are rotatably pivoted around locking hinge 26Lc, so as to lay flat juxtaposed on one another. The elbow arms preferably are made of metal, such as chrome plated steel, or another sturdy material suitable for a food environment. Those skilled in the art readily will appreciate alternative bracing, such as telescoping bracing, or other means for selectively, locking the frame in the open configuration, and releasing the frame for folding into the closed configuration.

Figure 4:
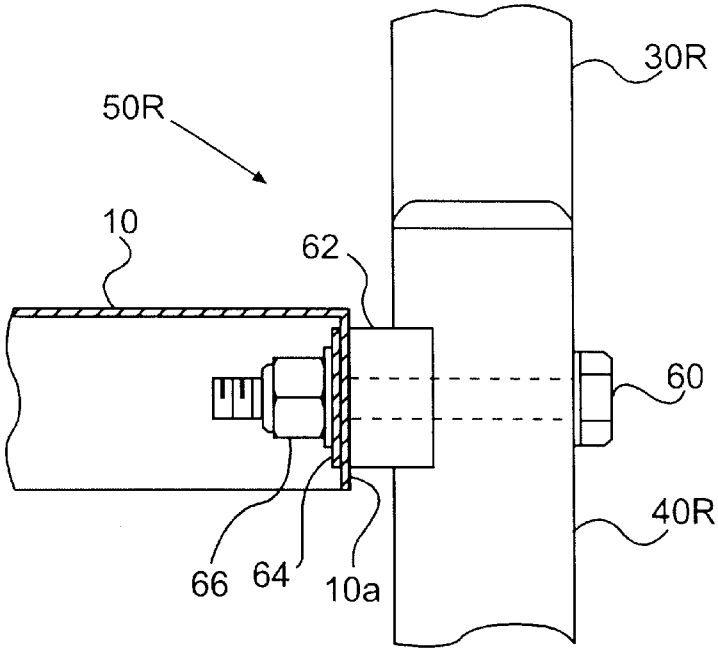
FIG. 4 is a partial cross-sectional view of a pivot connection, taken along lines 4—4 of FIG. 2, pivotably connecting the front end of the work surface and the front support frame.

FIG. 4 is a partial cross-sectional view of a typical pivot connection of the preferred embodiment, taken along lines 4—4 of FIG. 2, illustrating a pivot connection 50 pivotably connecting the front end of the work surface 10 and the second (front) support frame 24. As shown therein, a threaded bolt 60 (shown partially in phantom) sequentially is inserted through a pair of radially opposed holes (not shown) formed in the vertical support 40R, a spacer 62 having a recessed surface (not shown) for receiving the vertical support 40R, and a side wall (or flange) 10*a* of work surface 10. The threaded bolt 60 then is secured in place with a washer 64 and a threaded nut 66, so as to permit relative pivotal movement between vertical support 40R and work surface 10. The recessed surface of the spacer 62 preferably is crescent or semi-cylindrically shaped to compliment the shape of the vertical support 40R (see discussion below regarding spacers provided in other pivot connections). Those skilled in the art readily will appreciate alternative structures and methods for pivotably connecting the work surface 10 and the vertical support 40.

Figure 5:
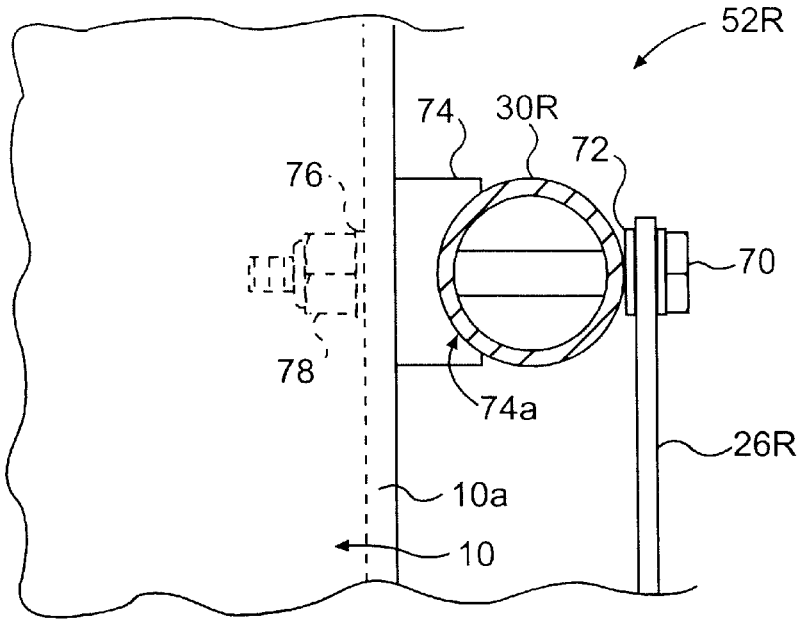
FIG. 5 is a partial cross-sectional view of a common pivot connection, taken along lines 5—5 of FIG. 2, pivotably connecting the rear end of the work surface, the rear support frame, and the locking brace.

FIG. 5 is a partial cross-sectional view of a typical common pivot connection of the present invention, taken along lines 5—5 of FIG. 2, illustrating a common pivot connection 52R pivotably connecting the rear end of the work surface 10, the first (rear) support frame 22, and the locking brace 26. As shown therein, a threaded bolt 70 (shown partially in phantom) sequentially is inserted through a hole (not shown) in the upper arm 26Ra of elbow brace 26R, a washer 72, a pair of radially opposed holes (not shown) formed in vertical support 30R, a spacer 74 having a recessed (crescent shaped) surface 74*a* for receiving vertical support 30R, and a hole (not shown) in the side wall 10*a* of work surface 10. The threaded bolt 70 then is secured in place with a washer 76 and a threaded nut 78 (each shown in phantom), so as to permit relative pivotal movement among locking brace 26R, vertical support 30R and work surface 10.

Figure 6:
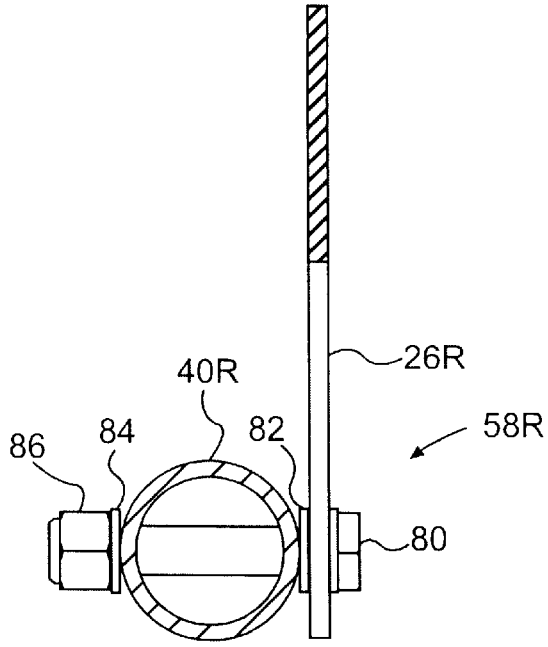
FIG. 6 is a partial cross-sectional view of a pivot connection, taken along lines 6—6 of FIG. 1, pivotably connecting the locking brace and the front support frame.

FIG. 6, is a partial cross-sectional view of a typical pivot connection, taken along lines 6—6 of FIG. 1, illustrating a pivot connection 58R pivotably connecting locking brace 26R and second (front) support frame 24. As shown therein, a threaded bolt 80 sequentially is inserted through a hole (not shown) in the lower arm 26Rb of locking brace 26R, a washer 82, and a pair of radially opposed holes (not shown) in vertical support 40R. The threaded bolt 80 then is secured in place with a washer 84 and a threaded nut 86, so as to provide relative pivotal movement between the locking brace 26R and the vertical support 40R.

Optional base shelf 26 preferably is a ventilated wire shelf, which provides a rigid, yet light weight structure. However, those skilled in the art readily will be able to select alternative materials and construction for base shelf 28 suitable for the intended application. As discussed below, the configuration of the preferred embodiment, including at least one optional shelf, e.g., a base shelf and/or an intermediate shelf, significantly improves the rigidity and stability of the work station.

Figure 7:
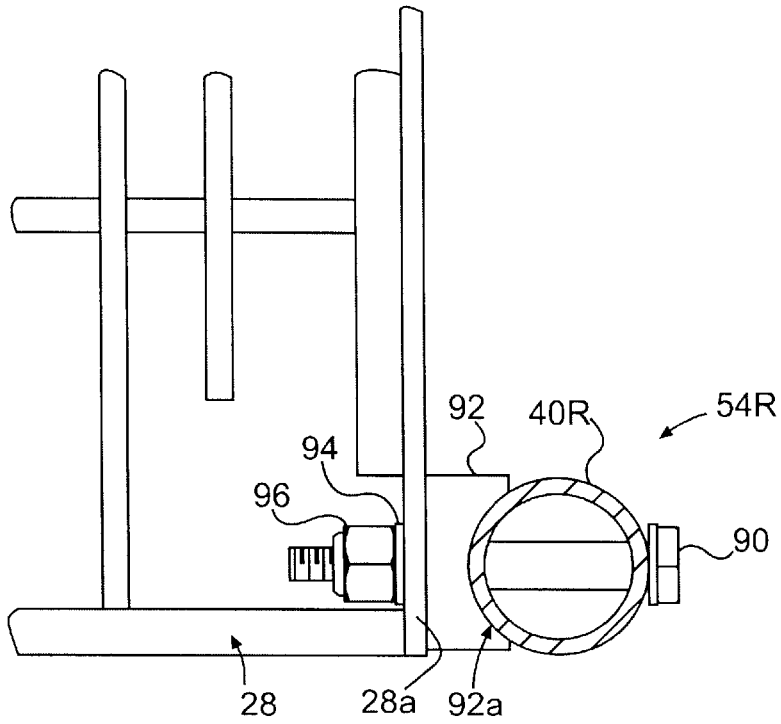
FIG. 7 is a partial cross-sectional view of a pivot connection, taken along lines 7—7 of FIG. 1, pivotably connecting a base shelf and the front support frame.

FIG. 7, is a partial cross-sectional view of a typical pivot connection, taken along lines 7—7 of FIG. 1, illustrating a pivot connection 54R pivotably connecting the optional base shelf 28 and the second (front) support frame 24. As shown therein, a threaded bolt 90 sequentially is inserted through a pair of radially opposed holes (not shown) formed in vertical support 40R, a spacer 92 having a recessed (crescent shaped) surface 92*a* for receiving the vertical support 40R, and a hole (not shown) in a side wall portion/flange 28*a* of the base shelf 28. The threaded bolt 90 then is secured in place with a washer 94 and a threaded nut 96, so as to provide relative pivotal movement between base shelf 26 and vertical support 30R.

As noted above, each support frame 30, 40 generally includes lateral support bracing. In the preferred embodiment, the lateral support bracing is provided by wire bracing, preferably using heavy gage wire conventionally used in ventilated wire shelving applications.

Referring again to FIGS. 1 and 2, the crown brace 32 is connected at opposing ends thereof to vertical supports 30R, 30L, and maintains the vertical supports at a predetermined spacing consistent with a width of work surface 10. In the preferred embodiment, the crown brace 32 is a ventilated wire structure including an upper wire 32*a*, a lower wire 32*b*, and a serpentine wire 32*c* connecting the upper and lower wires, as is well known in the art.

The crown brace 32 may be connected to the vertical supports 30R,30L by any conventional means. In the preferred embodiment, crown brace 32 is connected to vertical supports 30R, 30L by providing opposing ends of the upper wire 32*a* with extended portions which are inserted through respective pairs of radially opposed holes (not shown) formed in the upper ends of vertical supports 30R, 30L. The extended end portions preferably are secured in place with respective caps 33R, 33L. Caps 33 may be fixed to the extended end portions of upper and lower wires 32*a* by any conventional means, such as press fitting, welding, adhering, threading, etc. Of course, those skilled in the art readily will appreciate alternative structures and methods for securing the ends of cross brace 34 to the vertical supports 30R, 30L. (see also the discussion of stabilizing brace 42 below for details of connection design). The opposing ends of the lower wire 32*b* preferably are inserted through respective holes (not shown) formed only on interior facing sides of the vertical supports 30R, 30L (see FIG. 1). It will be appreciated that this construction prevents any rotation of the crown brace 32 about upper wire 32*a*, stabilizes the upper portion of the first support frame 20, and facilitates easy assembly thereof. However, those skilled in the art readily will appreciate alternative methods and structures for connecting opposing ends of the crown brace 32 to the vertical supports 30R, 30L.

The cross brace 34 generally comprises two wires arranged in an x-shape, with respective ends of each wire being connected to the vertical supports 30R, 30L. Similar to the connection of the crown brace 32 discussed above, each end of the cross brace wires may be bent and inserted through respective pairs of radially opposed holes (not shown) formed in the vertical supports 30R, 30L, and secured in place using conventional caps 35 (see FIG. 2). The caps 35 may be fixed to the extended end portions of the upper and lower wires 32*a*, by any conventional means, such as press fitting, welding, adhering, threading, etc. Of course, those skilled in the art readily will appreciate alternative structures and methods for securing the ends of cross brace 34 to the vertical supports 30R, 30L.

Although the preferred embodiment employs a cross brace 34 together with a crown brace 32 to provide lateral support for maintaining the first support frame 20 in a rigid configuration, those skilled in the art readily will appreciate alternative bracing structures and configurations for maintaining the first support frame 20 in a rigid configuration.

In the preferred embodiment, the stabilizing brace 42 has a design similar to the crown brace 32, and is comprised of an upper wire 42*a*, a lower wire 42*b*, and a serpentine wire 42*c* disposed therebetween. However, in the stabilizing brace 42, the serpentine wire 42*c* only is provided in a central section of stabilizing brace 42, and the upper and lower wires diverge from one another at each of the opposing ends of stabilizing brace 42. This arrangement provides both aesthetic and structural functions. However, those skilled in the art readily will appreciate alternative arrangements suitable for any desired application.

Figure 8:
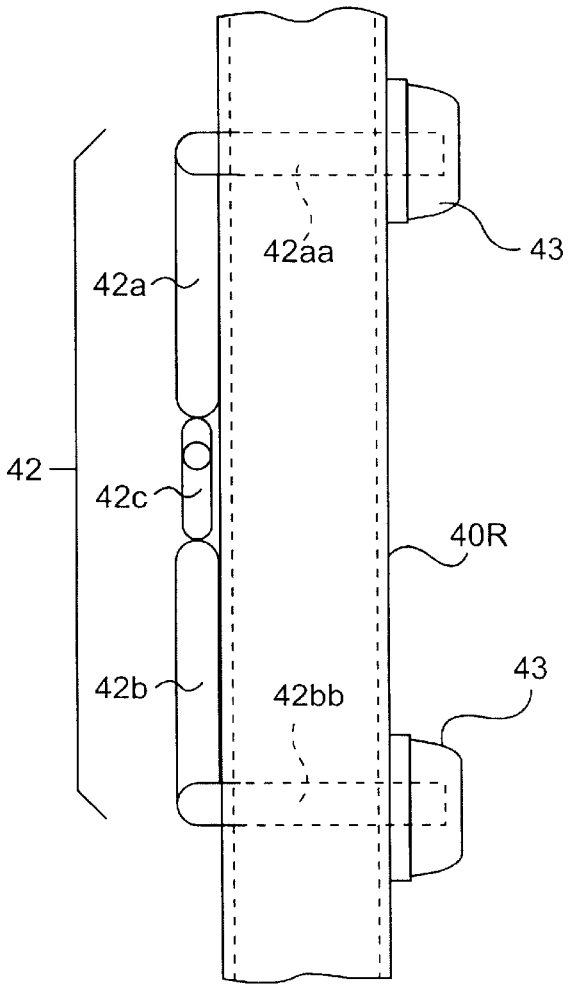
FIG. 8 is an enlarged view of a stabilizing brace connection taken from dot-dashed-line 8 in FIG. 2.

FIG. 8 illustrates a typical connection between a heavy gage wire brace and a vertical support. Specifically, each of the respective ends of upper wire 42*a* and lower wire 42*b* has a bent portion 42*aa*, 42*bb* that is inserted through a respective pair of radially opposed holes (not shown) formed in respective vertical supports 40R, 40L, and is secured in place using a press fit cap 43. Caps 43 may be fixed to the extended end portions of the upper and lower wires 42*aa*, 42*bb* by any conventional means, such as press fit, welding, threading, adhering, etc. Of course, those skilled in the art readily will appreciate alternative structures and methods for connecting each brace wire to a vertical support 40R, 40L.

The crown brace 32, the cross brace 34 and the stabilizing brace 42 are designed and configured to individually provide a desired amount of lateral and shear stability and rigidity to the respective first and second frames 22, 24 and, in combination with the foldable frame, the work surface 10 and any optional shelves, to collectively provide a desired lateral stability and rigidity to the folding work station. Of course, the illustrated number, structure and arrangement of these elements merely are provided as examples of stabilizing structures. Those skilled in the art readily will appreciate alternative structures and arrangements for providing appropriate lateral stability and rigidity for a particular application.

As discussed above, in the preferred embodiment predetermined spacings (W, w) respectively are provided between the vertical support posts 30R, 30L and 40R, 40L, and the spacings preferably are substantially equal (W≅w). In this manner, when the work station is folded to the second state (closed configuration), the second support frame 24 lays juxtaposed on the first support frame 22, and may be secured to the first support frame. In the preferred embodiment, the second support frame 24 is snap-locked onto the first support frame 22 by a pair of C-clips 44R, 44L, thereby to securely maintain the work station in the closed, folded configuration (see FIG. 3).

Figure 9:
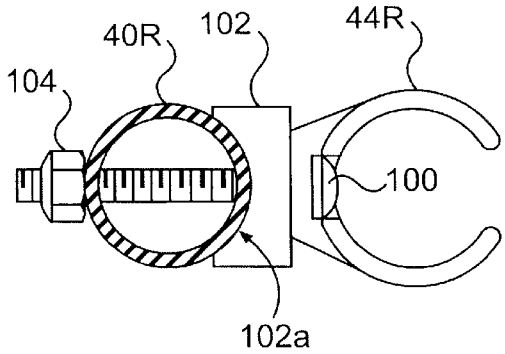
FIG. 9 is a partial cross-sectional view of a C-clip connector taken along lines 9—9 of FIG. 2.

FIG. 9 is a partial cross-sectional view of a C-clip connector taken along lines 9—9 of FIG. 2. As shown therein, a threaded bolt 100 sequentially is inserted through a resilient C-clip 44R, a spacer 102 having a recessed (crescent shaped) surface 102*a* for receiving vertical support 40R, and a pair of radially opposed holes (not shown) formed in the vertical support 40R. The threaded bolt 100 then is secured in place with a threaded nut 104.

In the embodiment of FIGS. 1 and 2, when locking braces 26 lock the work station in the first state (open configuration), the work surface 10 and the base shelf 28 are directly supported by the vertical supports 30R, 30L, 40R, 40L of the first and second support frames 22, 24, and the locking braces 28R, 28L cooperate with the work surface 10 and the shelf frame 26 to maintain the first and second support frames 22, 24, in a fixed spaced relation. It will be appreciated that in this manner the work station of the present embodiment provides a stable platform for presenting sample items, such as food samples or other articles in a restaurant, supermarket or department store; it also provides a stable shelf, e.g., for storing additional stock.

It also will be appreciated that, when the work station of the first embodiment is folded to the second state (closed configuration), the second frame 24, the work surface 10 and the base shelf 28 are supported juxtaposed on the first frame 22, and the work station readily and easily may be stored flat, e.g., laying down or standing substantially upright against a wall.

Also, when the work station is folded to the second state (closed configuration), the work station readily is transportable on rolling supports 36R, 36L, such as wheels, casters, rollers or like. In this regard, although the preferred embodiment of FIGS. 1 to 3 includes two rolling supports, it readily will be appreciated that the work station only requires one moving support structure to provide mobility.

In the preferred embodiment, at least one of the rolling supports 36R, 36L is arranged to provide rolling movement in a single direction only, that is, along a line in the plane of the first support frame 22. It will be appreciated that such an arrangement improves the stability of the work station while being transported and stored folded up in the second state (closed configuration), thereby facilitating safe, easy handling. Providing only two such movable supports, on the rear vertical supports 30R, 30L, also substantially eliminates undesired movement of the work station when sitting in the first state (open configuration).

Second Embodiment

Figure 10:
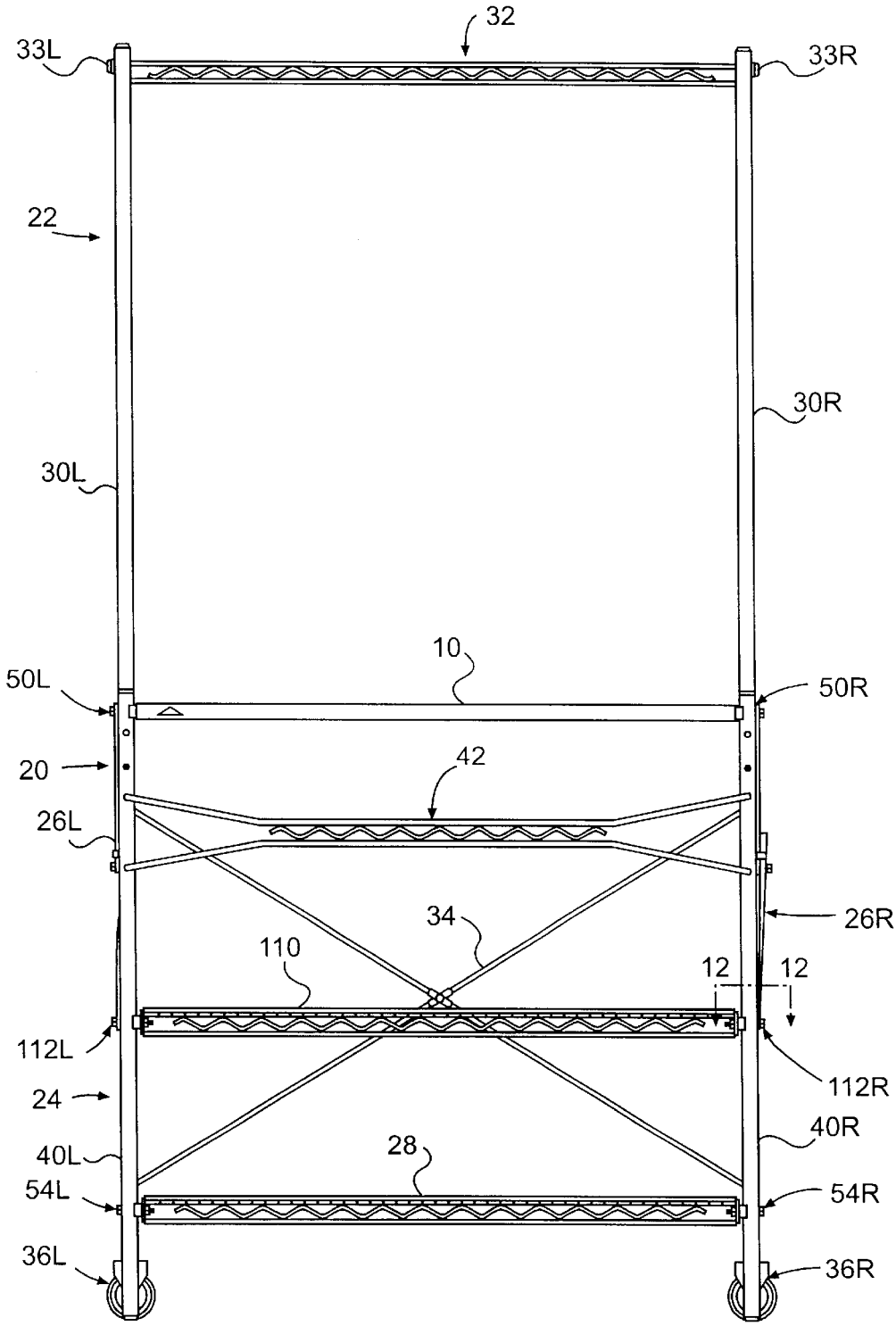
FIG. 10 is a front elevational view of a folding work station according to a second embodiment of the present invention, illustrating the folding work station in a first state, in which the work station is locked in an open configuration, and where the work station is provided with an optional base shelf and an optional intermediate shelf.
Figure 11:
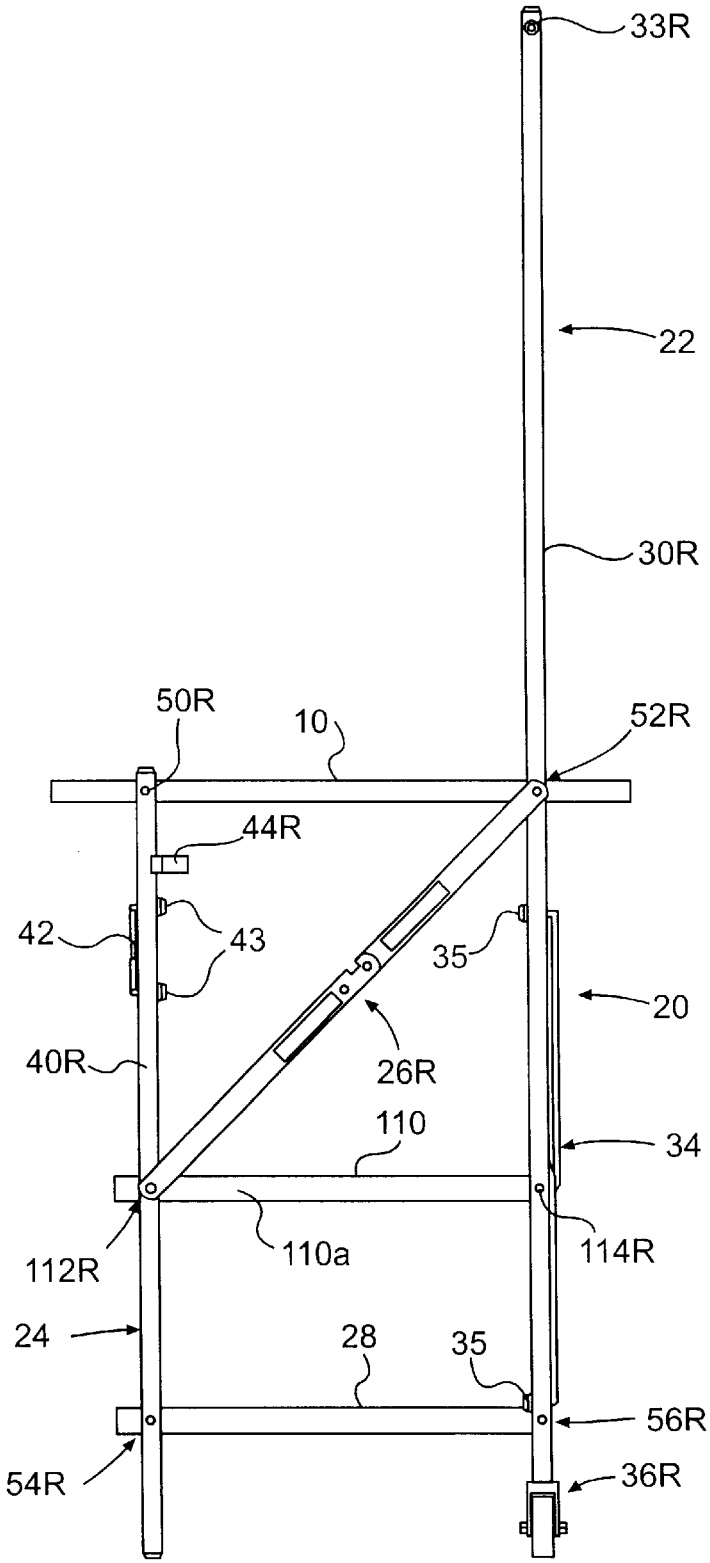
FIG. 11 is a side elevational view of the folding work station illustrated in FIG. 10.

FIG. 10 is a front view and FIG. 11 is a side view of a folding work station according to a second embodiment of the present invention. In this embodiment, the work station is provided with an optional base shelf and an optional intermediate shelf. Features of the second embodiment which are the same as the first embodiment are identified with the same reference numbers. Accordingly, description of these features is not repeated herein.

Optional intermediate shelf 110 generally has the same width as the work surface 10 but a reduced depth, and likewise provides a rigid structure extending between, and pivotably supported by each of, the first support frame 22 and the second support frame 24. More specifically, common pivot connections 112R, 112L are provided at opposing sides of one end of intermediate shelf 110 (the front end), whereby the second support frame 24 pivotably supports the front end of intermediate shelf 110 on a common pivot axis extending between vertical supports 40R, 40L; likewise, pivot connections 114R, 114L are provided at opposing sides of the other/opposing end of the intermediate shelf 110 (the rear end), whereby the first support frame 22 pivotably supports the rear end of intermediate shelf 110 on a common pivot axis extending between vertical supports 30R, 30L.

Referring particularly to FIG. 11, in the present embodiment the respective points of connection of each of the work surface 10 and the intermediate shelf 110 to the first and second support frames 30, 40 (that is, the respective pivot connections) are arranged with a selected spacing, such that, when the work station is in the open configuration, the first support frame 22, the second support frame 24, the work surface 10 and the intermediate shelf 110 form the four sides of a parallelogram, when viewed from the side of the work station.

As shown in FIG. 11, in the present embodiment the foldable frame 20 may be expanded to a first state, or open configuration, in which the first support frame 22, the second support frame 24, the work surface 10, and the intermediate shelf 110 are pivotably moved to form the four sides of a right parallelogram. In this state, each locking brace 26R, 26L may be locked so to fix the first support frame 22, the second support frame 24, the work surface 10 and the intermediate shelf 110 in a right parallelogram configuration.

Alternatively, similar to the first embodiment illustrated in FIG. 3, the locking braces 26R, 26L may be released, and the second support frame 24 may be lifted and rotatably pivoted, with the work surface 10, the intermediate shelf 110, and the base shelf 28, relative to the first support frame 22, so as to fold the frame to a second state, or closed configuration, in which the first support frame 22, the second support frame 24, the work surface 10, the intermediate shelf 110, and the base shelf 28 lay substantially flat relative to one another, juxtaposed in a vertical orientation.

As in the first embodiment, each of the various elements of the second embodiment may be made using conventional materials and construction.

Optional intermediate shelf 110 preferably is a ventilated wire shelf, which provides a rigid, yet light weight structure. However, those skilled in the art readily will be able to select alternative materials and constructions for the intermediate shelf 110 suitable for the intended application. As previously discussed, the configuration of the preferred embodiment, including at least one shelf, e.g., a base shelf and/or an intermediate shelf, significantly improves the rigidity and stability of the work station. However, the present embodiment, including an intermediate shelf 110 having a common pivot connection with locking brace 26, further improves the stability of the folding work station.

Figure 12:
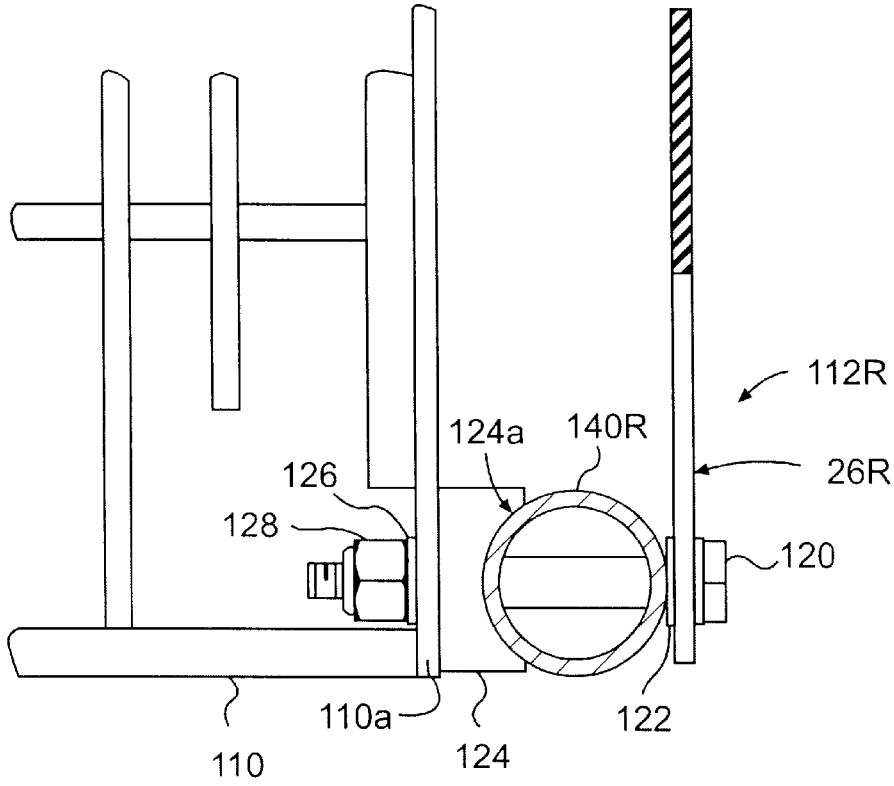
FIG. 12 is a partial cross-sectional view of a common pivot connection taken along lines 12—12 of FIG. 10, pivotably connecting a front end of the intermediate shelf, the front support frame, and the locking brace.

FIG. 12 is a partial cross-sectional view of a common pivot connection taken along lines 12—12 of FIG. 10, pivotably connecting a front end of the intermediate shelf frame 110, the front support frame 24, and the locking brace 26. In the preferred embodiment, common pivot connection 112R comprises a threaded bolt 120 sequentially inserted through a hole (not shown) in the lower arm 26Rb of locking brace 26R, a washer 122, a pair of radially opposed holes (not shown) formed in the vertical support 40R, a spacer 124 having a recessed (crescent shaped) surface 124*a* for receiving the vertical support 40R, and a hole (not shown) in a side wall or flange 110*a* of the intermediate shelf 110. The threaded bolt 120 then is secured in place with a washer 126 and a threaded nut 128, so as to permit relative pivotal movement among the intermediate shelf 110, the vertical support 40R and the locking brace 26R.

While the present invention has been described with respect to what is presently considered to be the preferred embodiments, the present invention is not limited to the disclosed embodiments. Rather, the present invention covers various modifications and equivalent arrangements included within the spirit and scope of the appended claims. The scope of the appended claims is to be accorded the broadest interpretation so as to encompass all such modifications and equivalent structures and functions.

What is claimed is:

1. A folding work station comprising:

a work surface; and a frame supporting said work surface, said frame including at least one rolling support and being selectively expandable to an open configuration, in which said frame supports said work surface in a working orientation, and foldable to a substantially flat closed configuration having a vertical orientation, in which said frame supports said work surface juxtaposed on said frame and the work station is movably supported on said at least one rolling support, at least one of said at least one rolling support providing movement substantially only along a line generally in a plane of said frame in the substantially flat closed configuration.

2. A folding work station according to claim 1, wherein said frame supports said work surface at fixed support locations at opposing ends of the work surface.

3. A folding work station according to claim 2, further comprising:

respective pivot connections between said frame and said work surface at said fixed support locations.

4. A folding work station according to claim 1, wherein said at least one rolling support includes at least a rolling support selected from the group consisting of a caster, a roller, and a wheel.

5. A folding work station according to claim 1, wherein each rolling support includes locking means for selectively locking said roller support to prevent undesired movement of the folding work station.

6. A folding work station comprising:

a work surface;

a first support frame;

a second support frame; and a foldable frame, said foldable frame connecting said first support frame, said second support frame and said work surface for relative movement between an open configuration, in which said second support frame is fixed relative to said first support frame at a location spaced apart from said first support frame, with said work surface supported between said first support frame and said second support frame, and a closed configuration, in which said second support frame, said foldable frame, and said work surface are supported juxtaposed on said first support frame, in a substantially flat closed configuration having a vertical orientation.

7. A folding work station according to claim 6, further comprising at least one rolling support, wherein when the foldable frame is in the closed configuration, said work station is movably supported on said at least one rolling support, and wherein at least one of said at least one rolling support is disposed only on said first support frame and allows for movement substantially only along a line generally in a plane of said first support frame.

8. A folding work station according to claim 6, wherein said folding framing comprises a locking brace, and wherein, in the open configuration, said locking brace cooperates with said first support frame, said second support frame and said work surface so as to fix said second support frame at a location spaced apart from said first support frame, with said work surface supported between said first support frame and said second support frame.

9. A folding work station according to claim 8, wherein one end of said locking brace is pivotably supported at a common pivot connection between said work surface and one of said first support frame and said second support frame, and the other end of said locking brace is pivotably supported at a pivot connection on the other one of said first support frame and said second support frame.

10. A folding work station according to claim 8, further comprising:

an intermediate shelf supported by said first support frame and said second support frame at fixed support locations at opposing ends of said intermediate shelf, wherein said foldable frame includes respective pivot connections between said first and second support frames and said intermediate shelf at the fixed support locations, wherein said intermediate shelf has a width substantially similar to said work surface, and is spaced apart from said work surface so as to form a parallelogram with said work surface, said first support frame and said second support frame, when viewed from a side of the work station, and wherein one end of said locking brace is pivotably connected at a common pivot connection between said work surface and one of said first support frame and said second support frame, and the other end of said locking brace is pivotably connected at a common pivot connection between said intermediate shelf and the other one of said first support frame and second support frame.

11. A folding work station according to claim 10, wherein said second shelf is a ventilated wire shelf.

12. A folding work station according to claim 6, further comprising:

a base shelf supported by said first support frame and said second support frame at fixed support locations at opposing ends of said base shelf.

13. A folding work station according to claim 12, wherein said frame further comprises respective pivot connections between said first and second support frames and said base shelf at the fixed support locations.

14. A folding work station according to claim 12, wherein said base shelf is a ventilated wire shelf.

15. A folding work station according to claim 12, wherein said base shelf has a width substantially similar to said work surface, and is spaced apart from said work surface so as to form a parallelogram with said work surface, said first support frame and said second support frame, when viewed from a side of the work station.

16. A folding work station according to claim 6 further comprising:

securing means, disposed on at least one of said first support frame and said second support frame, for securing said first support frame together with said second support frame, when the folding work station is folded in the closed configuration, and said second support frame is supported juxtaposed on said first support frame.

17. A folding work station according to claim 16, wherein said securing means comprises at least one resilient C-clip.

18. A folding workstation according to claim 6, wherein the first support frame has a height sufficiently greater than a height of the second support frame to permit continuous display of items on the first support frame when the folding workstation is in the first state or the second state.

19. A folding work station, comprising:

a first support frame having at least one movable support;

a second support frame;

a work surface pivotably connected at one end thereof to said first support frame and pivotably connected at an opposing end thereof to said second support frame; and a locking brace connecting said first support frame and said second support frame, said locking brace being connected at one end thereof, at a first common pivot connection, with said work surface and one of said first support frame and said second support frame;

wherein said work surface and said locking brace cooperate to selectively permit relative movement between said first support frame and said second support frame between a first state, in which said second support frame is fixed by said locking brace at a location spaced apart from said first support frame, with said work surface supported between said first support frame and said second support frame, and a second state, in which said second support frame and said work surface are supported juxtaposed on said first support frame, and the work station is movable on said at least one movable support.

20. A folding work station according to claim 19, further comprising:

a base shelf pivotably connected at one end thereof to said first support frame and pivotably connected at the other end thereof to said second support frame, said shelf being arranged substantially parallel to and spaced apart from said work surface.

21. A folding work station according to claim 20, further comprising:

an intermediate shelf pivotably connected at one end thereof to said first support frame and pivotably connected at the other end thereof to said support second frame, said intermediate shelf being disposed between said work surface and said base shelf.

22. A folding work station according to claim 21, wherein said locking brace is pivotably connected at the other end thereof, at a second common pivot connection, with said intermediate shelf and the other one of said first support frame and said second support frame.

23. A folding work station according to claim 19, wherein said at least one movable support is selected from the group consisting of casters, rollers and wheels.

24. A folding work station according to claim 19, wherein said at least one movable support provides movement substantially only along a line generally in a plane of said first support frame.

25. A folding work station comprising:

a work surface;

means for supporting said work surface in a first state, in which said work surface has an open, working orientation, and in a second state, in which said work surface has a closed orientation and said folding work station has a substantially flat, vertical orientation; and means for movably supporting said supporting means in the second state, said movably supporting means including at least one movable means providing movement substantially only along a line generally in a plane of said supporting means in the substantially flat, closed orientation.

26. A folding work station according to claim 25, wherein said supporting means is movably supported in the second state only.

27. A folding work station comprising:

a work surface;

a frame supporting said work surface, said frame being selectively expandable to an open configuration, in which said frame supports said work surface in a working orientation, and foldable to a substantially flat closed configuration having a vertical orientation, in which said frame supports said work surface juxtaposed on said frame; and a locking brace having at one end thereof a common pivot connection with said work surface and said frame, wherein when said frame is in the open configuration, said locking brace is operable to lock said frame in the open configuration, and when said frame is in the closed configuration, said locking brace folds juxtaposed on said frame.

28. A folding work station according to claim 27, wherein said locking brace further has at the other end thereof a common pivot connection with said frame.

29. A folding work station comprising:

a work surface;

a frame supporting said work surface, said frame being selectively expandable to an open configuration, in which said frame supports said work surface in a working orientation, and foldable to a substantially flat closed configuration having a vertical orientation, in which said frame supports said work surface juxtaposed on said frame; and a locking brace, wherein when the frame is in the open configuration, said locking brace is operable to lock said frame in the open configuration, and when said frame is in the closed configuration, said locking brace folds juxtaposed on said frame and work surface.

30. A folding work station comprising:

a collapsible parallelogram frame with a work surface defining a side thereof, said frame folding between an open configuration, in which said work surface is supported by said frame in a working orientation, and a closed configuration, in which said frame and work surface are folded juxtaposed on one another with a substantially flat vertical profile.

31. A folding work station according to claim 30, further comprising:

at least one rolling support, said frame being movable on said rolling support in the closed configuration.

32. A folding work station according to claim 31, wherein at least one of said at least one rolling support is movable substantially only along a line generally in a plane of the frame in the substantially flat profile closed configuration.

33. A folding work station according to claim 30, said frame further comprising:

a locking brace that locks said frame in the open configuration, said locking brace having a common pivot connection with said frame at one end of said working surface.

34. A folding work station according to claim 30, said frame further comprising:

a locking brace that locks said frame in the open configuration, and folds juxtaposed on said frame in the substantially flat profile closed configuration.

35. A folding work station according to claim 30, wherein one side of said frame adjacent said work surface has a vertical extension sufficiently long to receive said frame and work station folded juxtaposed thereon in the substantially flat vertical closed configuration, and further provides a continuously viewable display area.

36. A folding work station according to claim 30, said frame further comprising securing means for securing the frame in the closed configuration.

37. A folding work station comprising:

a work surface; and a frame supporting said work surface, said frame being selectively expandable to an open configuration, in which said frame supports said work surface in a working orientation, and foldable to a substantially flat closed configuration having a vertical orientation, in which said frame supports said work surface juxtaposed on said frame, said frame further including a vertical extension sufficiently long to provide a continuous visual display.

* * * * *

UNITED STATES PATENT AND TRADEMARK OFFICE

CERTIFICATE OF CORRECTION

PATENT NO. : 6,698,364 B2
DATED : March 2, 2004
INVENTOR(S) : Robert J. Welch et al.

It is certified that error appears in the above-identified patent and that said Letters Patent is hereby corrected as shown below:

Column 12,
Line 31, "framing" should read -- frame --.

Column 14,
Line 3, "support second" should read -- second support --.

Signed and Sealed this

Twenty-first Day of June, 2005

JON W. DUDAS
*Director of the United States Patent and Trademark Office*